US006037958A

United States Patent [19]

Terauchi et al.

[11] Patent Number: 6,037,958

[45] Date of Patent: Mar. 14, 2000

[54] METHOD FOR CLEANING THERMAL PRINTING HEAD

[75] Inventors: Junichi Terauchi; Ryuta Ono, both of Inashiki-gun, Japan

[73] Assignee: Riso Kagaku Corporation, Tokyo, Japan

[21] Appl. No.: 08/917,945

[22] Filed: Aug. 27, 1997

[30] Foreign Application Priority Data

Aug. 28, 1996 [JP] Japan ..... 8-246989

[51] Int. Cl.[7] ..... B41J 29/17; B41J 2/38

[52] U.S. Cl. ..... 347/171; 347/186

[58] Field of Search ..... 400/120.08, 701, 400/702; 347/185, 186, 171, 211

[56] References Cited

U.S. PATENT DOCUMENTS

| | | |
|---|---|---|
| 4,947,190 | 8/1990 | Mizusawa . |
| 5,030,292 | 7/1991 | Koike . |
| 5,559,545 | 9/1996 | Fuwa . |

FOREIGN PATENT DOCUMENTS

| | | | |
|---|---|---|---|
| 62077973 | 4/1987 | European Pat. Off. . | |
| 0 379 959 A2 | 8/1990 | European Pat. Off. . | |
| 02204076 | 8/1990 | European Pat. Off. . | |
| 0 581 344 A1 | 2/1994 | European Pat. Off. . | |
| 63-114691 | 5/1988 | Japan . | |
| 1-297285 | 11/1989 | Japan | 400/702 |
| 2-204076 | 8/1990 | Japan | 400/702 |
| 6-239047 | 8/1994 | Japan . | |
| 07223307 | 8/1995 | Japan . | |
| 7-309002 | 11/1995 | Japan . | |
| WO93/21020A | 10/1993 | WIPO . | |

*Primary Examiner*—Huan Tran
*Attorney, Agent, or Firm*—Pillsbury Madison & Sutro LLP

[57] ABSTRACT

A method for cleaning a thermal printing head, particularly in use for perforating stencil sheets, is provided, which does not require a special stencil sheet nor damage the thermal printing head, but makes it possible to remove deposits as required. The method is a method for cleaning a thermal printing head having a plurality of heating elements arranged transversely to a direction in which an article to be recorded is conveyed, which comprises heating and softening deposits appearing in the vicinity of said heating elements, and conveying a sheet in the above direction while said sheet is kept in contact with said heating elements so that said softened deposits are moved downwardly in the above direction. Said sheet may be a stencil sheet, and preferably the heating elements are all turned on to heat and soften deposits, so as to make perforations for solid printing in said stencil sheet.

9 Claims, 3 Drawing Sheets

METHOD FOR CLEANING THERMAL PRINTING HEAD

BACKGROUND OF THE INVENTION

1. Field of the Invention

The present invention relates to a method for cleaning a thermal printing head in use for perforating a stencil sheet and the like.

2. Background of the Invention

Stencil printing is effected by a perforating step in which perforations corresponding to an image to be printed, namely an "original", are made in a stencil sheet, and a printing step in which ink is transferred to printing paper through the perforations of the perforated stencil sheet. As stencil sheets, have widely been used heat-sensitive stencil sheets which are composed of an ink-impermeable thermoplastic film such as of polyester laminated to an ink-permeable porous substrate such as of Japanese paper.

Such heat-sensitive stencil sheets can be perforated by means of a thermal printing head which has in a longitudinal direction thereof fine heating elements arranged in a row. In other words, perforations corresponding to an original can be made in the stencil sheet by bringing the stencil sheet into contact with the thermal printing head, and heating a plurality of heating elements selected in accordance with image data of the original so as to melt the thermoplastic film of the stencil sheet.

The thermal printing head generally has an elongated configuration. The stencil sheet is perforated while it is pressed to and conveyed on the thermal printing head by means of a platen roller disposed opposite to the thermal printing head. Herein, the longitudinal direction of the thermal printing head is referred to as "horizontal scanning direction", and the direction which is transverse to the horizontal scanning direction and in which the stencil sheet is conveyed is referred to as "vertical scanning direction".

The stencil sheet is often provided on the surface of the thermoplastic film with a releasing agent layer made of fluorinated resins or the like in order to prevent scum of the molten film from sticking to heating elements upon perforation. However, when the thermal printing head is repeatedly used for perforation of stencil sheets, not only scum of the molten film but also adhesives bonding the film to a substrate such as paper and something like that gradually stick to and deposit in the neighborhood of heating elements of the printing head. Such deposits are found remarkable at the end of heating elements on the side downstream to the direction in which stencil sheets are conveyed. If deposits grow too large, close contact of the film with heating elements is interrupted upon perforation. Also, conveyance of the film is interrupted due to increase in friction between the film and the printing head, so that the film becomes difficult to be perforated, causing printed image to gradually deteriorate.

It has been a conventional operation that when deposits are found in the vicinity of heating elements of the thermal printing head, operators wipe off the deposits by use of alcohol or the like. Since it is quite troublesome to remove deposits every time they occur, a method for removing deposits, in which a polishing layer formed on part of a roll of stencil sheet is pressed to the thermal printing head, is disclosed in Japanese Patent Laid-open (Kokai) Nos. 239047/94 and 309002/95.

In such a method for removing deposits using polishing layers, life of the thermal printing head might be shortened by polishing action. Further, an additional manufacturing step is required to form the polishing layer on stencil sheets, making the manufacturing process complicated.

Furthermore, since deposits are removed by the stencil sheet only at portions where polishing layers are previously formed, interval between cleanings of the thermal printing head cannot be varied depending upon degree of deposition. When a roll of stencil sheet is provided with the polishing layer at regular intervals of a length required for making one master, that is the length of a stencil sheet required for each printing, perforation might be made in the stencil sheet at portions where the polishing layer is formed, due to expansion, shrinkage or the like. When the polishing layer is formed at the beginning and/or last end of a roll of stencil sheet, the thermal printing head is cleaned only once or twice until the roll is all spent.

The object of the present invention is to provide a method for cleaning a thermal printing head, which does not require a special stencil sheet nor damage the thermal printing head, but makes it possible to remove deposits as required.

SUMMARY OF THE INVENTION

According to the present invention, the above object is attained by a method for cleaning a thermal printing head having a plurality of heating elements arranged transversely to a direction in which an article to be recorded is conveyed, which comprises heating and softening deposits appearing in the vicinity of the heating elements, and conveying a sheet in the above direction while said sheet is kept in contact with said heating elements, so that said softened deposits are moved downwardly in the above direction.

DETAILED DESCRIPTION

Figure 1:
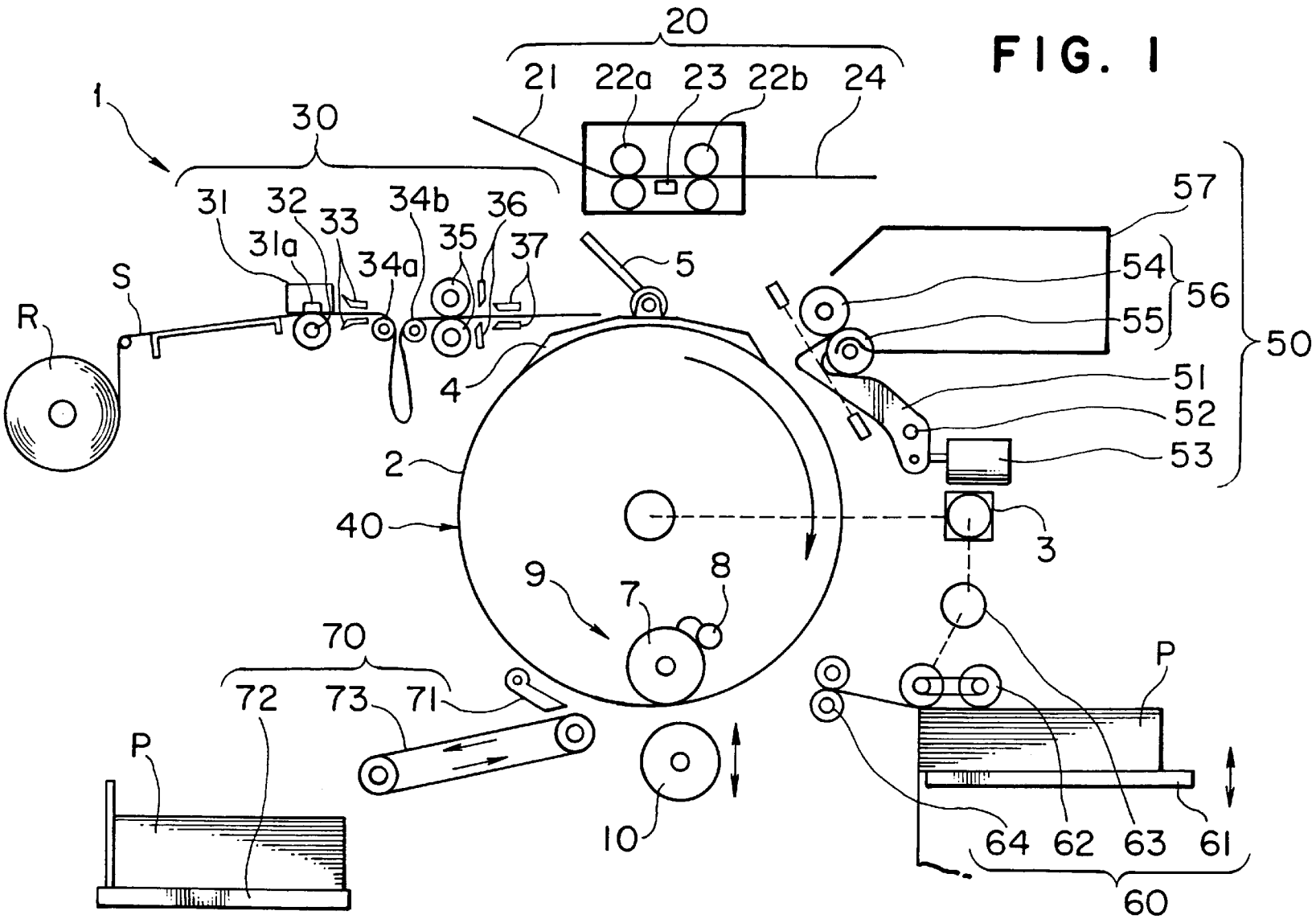

In other words, according to the present cleaning method, deposits present in the neighborhood of heating elements of the thermal printing head are heated to soften, and thus are changed to flowable or viscous state from solid fixed to the thermal printing head. In this state, a sheet is conveyed while being kept in contact with heating elements, and thus the softened deposits are moved from the vicinity of the heating elements downwardly in the direction of conveyance of the sheet or removed from the thermal printing head, by virtue of the movement of the sheet relative to the heating elements.

The sheet may be one which is not molten by heat of heating elements, and includes paper, plastic films such as of polyethylene terephthalate (PET), and a substance per se to be recorded by the thermal printing head. Such a substance to be recorded is, for example, heat-sensitive recording paper in case of facsimile machines, and heat-sensitive stencil sheet to be perforated for making a master in case of plate- or master-making apparatuses for stencil printing machines.

In the present invention, the step of heating and softening deposits can be practiced, for example, by turning on the heating elements to soften the deposits by heat emitted from the elements. When a platen roller is disposed opposite to the thermal printing head, the step may be practiced by providing means for heating the surface of the platen roller, and softening the deposits by the surface of the platen roller heated by the heating means.

In the present invention, as long as deposits are in a state softened by heat, the sheet only has to be conveyed while being kept in contact with the heating elements. Therefore, the sheet may be conveyed, for example, (1) at the same time when heating elements are turned on to soften the deposits, (2) after heating elements have been turned off when the deposits become soften by heat of heating elements, or (3) while heating elements remain turned on after the deposits have been softened by heat of heating elements.

The present cleaning method can be suitably used for preventing deposits from accumulating on a thermal printing head which is used in a unit for perforating heat-sensitive stencil sheets to make a master for stencil printing. Such a perforating unit usually comprises a thermal printing head composed of a plurality of heating elements arranged transversely to a direction in which stencil sheets are conveyed, and a platen roller which conveys stencil sheets while keeping said stencil sheets in contact with the thermal printing head.

In the perforating unit as above, accumulation of deposits can be prevented by a first step of conveying said stencil sheet in the conveying direction by a predetermined distance while said heating elements are turned on to heat the vicinity of said elements, in order to prevent deposits from adhering to said thermal printing head, and a second step of further conveying said stencil sheet in the above direction in order to make perforations in the region upstream of the stencil sheet in accordance with an image to be printed. In the first step, it is preferable that all the heating elements are turned on and heated in a manner in which perforations for solid images are made in the stencil sheet.

In the perforating unit as above, accumulation of deposits may be prevented by a first step of turning on said heating elements until the vicinity of said elements is heated, and then immediately turning off the elements and conveying said stencil sheet in the conveying direction by a predetermined distance, in order to prevent deposits from adhering to said thermal printing head, and a second step of further conveying said stencil sheet in the above direction in order to make perforations in the region upstream of the stencil sheet in accordance with an image to be printed.

In the perforating unit as above, accumulation of deposits may be prevented by a first step of turning on said heating elements until the vicinity of said elements is heated, and conveying said stencil sheet in the conveying direction by a predetermined distance while said elements are kept turned on, in order to prevent deposits from adhering to said thermal printing head, and a second step of further conveying said stencil sheet in the above direction in order to make perforations in the region upstream of the stencil sheet in accordance with an image to be printed.

In the perforating unit as above, deposits can be usually softened by turning on the heating elements to heat the vicinity thereof to 50° C. or higher. The first step is conducted in order to clean the thermal printing head. The cleaning of the first step may be conducted every time before the second step is made, or once after the second step has been carried out several times.

Figure 2:
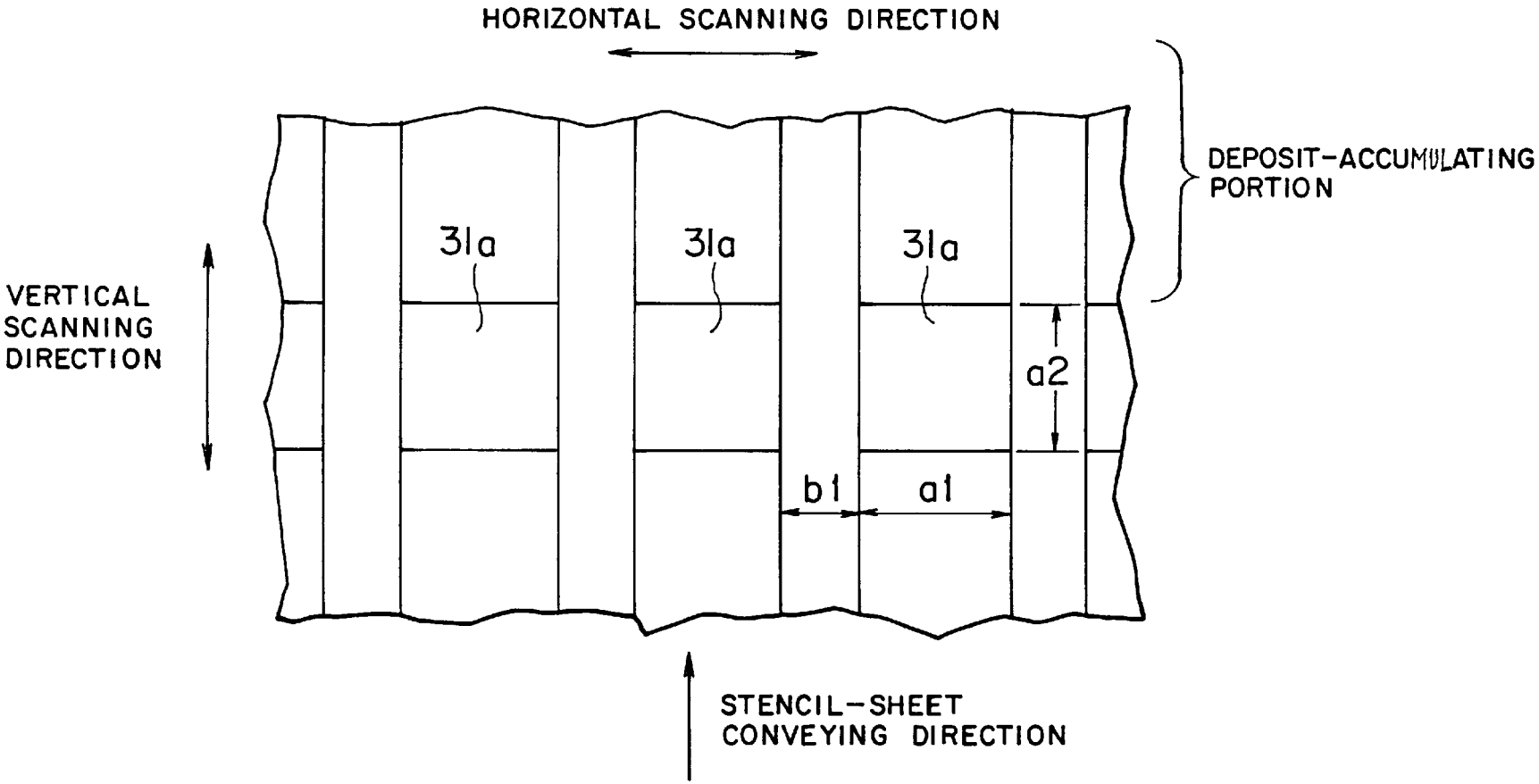
Figure 3:
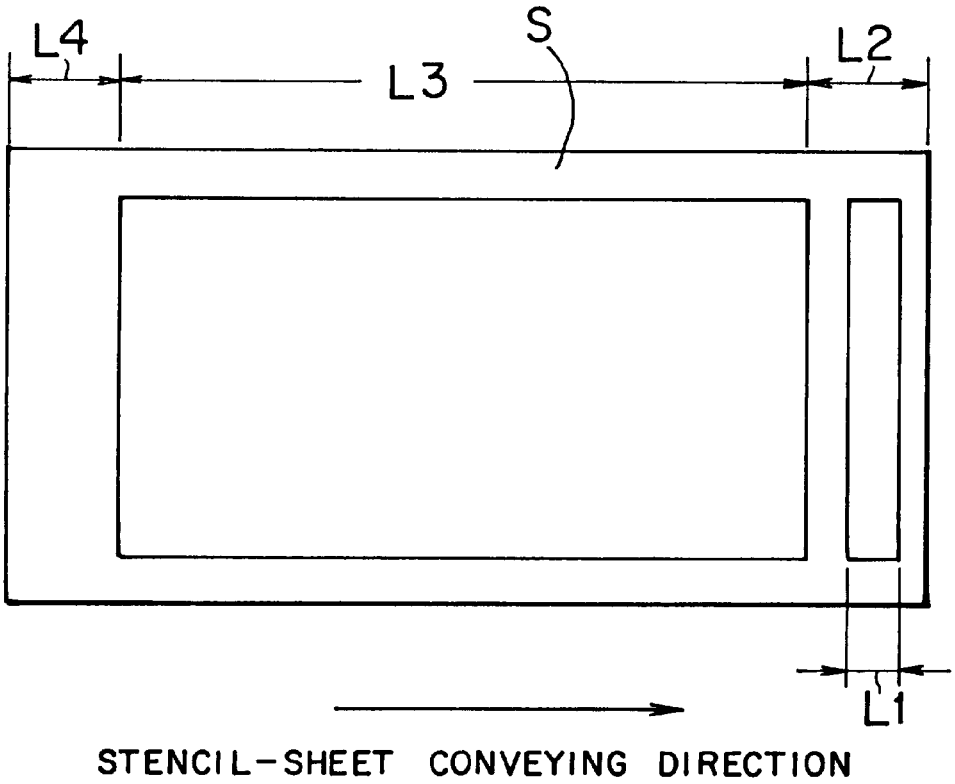

Hereinafter, the present invention is explained in more details with reference to an embodiment shown in the accompanying drawings, in which FIG. 1 is a schematic side view showing the inside structure of a rotary stencil printing apparatus to which the present method for cleaning a thermal printing head can be adapted, FIG. 2 is a schematic enlarged view showing an arrangement of heating elements of the thermal printing head used in the rotary stencil printing apparatus of FIG. 1, and FIG. 3 is a schematic plan view showing a stencil sheet to be wound around the printing drum of the rotary stencil printing apparatus as a master for printing one original.

It should be construed that the following embodiment is presented for only illustrative purpose, and the present invention is not limited to the embodiment.

FIG. 1 diagrammatically shows the inside structure of an embodiment of the rotary stencil printing apparatus to which the present cleaning method can be adapted. The stencil printing apparatus 1 comprises original-image scanning unit 20, thermally master-making unit 30, stencil printing unit 40, stencil discharging unit 50, paper feeding unit 60, and paper discharging unit 70.

The original-image scanning unit 20 includes an original feeder tray 21 on which an original to be printed is placed, two pairs of rollers 22*a* and 22*b* which convey the original placed on the original feeder tray 21, an image sensor 23 such as of the contact type that optically scans the image on the original and transforms it into electric signals, and an original discharge tray 24 to which the scanned original is discharged.

The master-making unit 30 includes a thermal printing head 31 which extends in the direction vertical to the plane of FIG. 1, namely, the horizontal scanning direction, and a platen roller 32 which is disposed opposite to the thermal printing head 31. The platen roller 32 rotates while pressing heat-sensitive stencil sheet S unwound from the roll R to the thermal printing head 31, thereby thermally perforating the stencil sheet S and conveying it to the printing drum 2 described below. On the downstream side of the thermal printing head 31 and the platen roller 32 in the direction in which the stencil sheet is conveyed, are disposed, in order, a pair of guide plates 33 vertically opposed to each other, a pair of guide rollers 34*a* and 34*b* disposed adjacent to each other in the stencil-sheet conveying direction, a pair of conveying rollers 35 vertically opposed to each other to sandwich the stencil sheet and feed it to the printing drum 2, a stencil-sheet cutter 3 composed of a pair of blades vertically opposed to each other to cut a perforated stencil sheet to a predetermined length required for printing, and a pair of guide plate 37 vertically opposed to each other. The pair of guide rollers 34*a* and 34*b* are controlled so as to trap the stencil sheet between them until the perforated stencil sheet is wound around the printing drum 2.

The stencil printing unit 40 includes a printing drum 2 which has an ink-permeable cylindrical circumferential wall and can rotate around the central axis thereof, The printing drum 2 is driven by a main motor 3 to rotate clockwise as seen in FIG. 1. The printing drum 2 has an ink-impermeable stage portion 4 on a part of the circumferential wall. A clamp plate 5, which is swingable to open or shut, is pivoted as clamping means to the stage portion 4. The clamp plate 5 can swing about 180 degrees on the stage portion 4 so that the top end of the stencil sheet S can be clamped between the stage portion 4 and the clamp plate 5 or released selectively.

An ink-feeding mechanism 9 including a squeeze roller 7 and a doctor roller 8 is disposed inside the printing drum 2, so that ink is fed to the interior wall of the printing drum 2. Outside the printing drum 2, a press roller 10 which can move up and down is disposed opposite to the squeeze roller 7. Printing paper P which has been fed between the press roller 10 and the printing drum 2 synchronously with rotation of the printing drum 2, is pressed by the press roller 10 to the outside wall of the printing drum 2, so that ink passing through the ink-permeable portion of the printing drum 2 and the perforations of the stencil sheet S is transferred to the printing paper P.

The stencil discharging unit 50 includes a claw 51 for removing the stencil sheet from the printing drum 2. The claw 51 is swingably supported by an axis 52, and is linked at a root portion thereof to a solenoid 53 for driving the claw. As the solenoid 53 is driven, the claw 51 swings around the axis 52 within a predetermined range of angle. In other words, the claw 51 is driven to move between a first portion where the tip of the claw 51 approaches the surface of the printing drum 2 to peel off the stencil sheet S and a second position where the claw is retracted at a predetermined distance from the printing drum 2. At the first position, the tip of the claw 51 peels the stencil sheet S off the printing drum 2. Then, the claw 51 holding the stencil sheet S is returned to the second position.

At the second position, the tip of the claw 51 is adjacent to a pair of discharging rollers 56 which is disposed at an inlet of a stencil disposal box 57 and consists of an upper roller 54 and a lower roller 55. Thus, the claw 51 puts the peeled stencil sheet S between the rollers 54 and 55 to allow the disposal box 57 to receive the stencil sheet by means of the rollers 54 and 55.

The paper feeding unit 60 includes a paper feeder tray 61 which can be moved upwards and downwards with a load of pieces of printing paper P by means of elevation means not shown in the drawings, a pick-up roller 62 which takes printing paper P piece by piece from the paper feeder tray 61, a clutch 63 which intermittently transmits rotation of the main motor 3 to the pick-up roller 62, and a pair of paper conveying rollers 64 which feeds printing paper P between the printing drum 2 and the press roller 10 in accordance with a predetermined timing.

The paper discharging portion 70 includes a claw 71 for separating a printed piece of printing paper P from the printing drum 2, and a belt-conveyor type discharging means 73 which conveys the printed piece of printing paper P to a paper discharge tray 72 after the paper has been peeled off the printing drum 2 by the claw 71.

EXAMPLES

Example 1

The present method for cleaning a thermal printing head was practiced by use of the rotary stencil printing apparatus shown in FIG. 1. The thermal printing head 31 of FIG. 1 was composed of a plurality of heating elements 31*a* arranged in a row in the horizontal scanning direction as shown in FIG. 2. Each heating element 31*a* was rectangular having a length a1 of 45 μm in the horizontal scanning direction and a length a2 of 60 μm in the vertical scanning direction. The space b1 between the adjacent two heating elements 31*a* was 40 μm in the horizontal scanning direction. The pitch at which the stencil sheet was conveyed in the vertical scanning direction of the thermal printing head upon perforation was 85 μm.

Example 1

Cleaning by Use of Wood Free Paper as a Deposit-cleaning Sheet in Solid Printing Mode By use of the rotary stencil printing apparatus of FIG. 1, the step for making masters for stencil printing from the roll of stencil sheet S was repeated two-hundred (200) times based on an original having 20% printed area, after the thermal printing head had previously been cleaned. Then, deposits were formed on the thermal printing head on a side downstream in the stencil-sheet conveying direction, which originated from a point within 100 μm outwardly from the downstream end of heating elements and further extended outwardly therefrom.

Next, a piece of wood free paper, which had a size corresponding to a master required for A4 size printing and was 90 μm thick, was set as a deposit-cleaning sheet in place of the stencil sheet in the printing apparatus of FIG. 1, and was allowed to pass the thermal printing head which was kept turned on in the solid printing mode in which all the heating elements were heated.

After the deposit-cleaning sheet that had passed the thermal printing head was clamped at an end thereof and wound around the printing drum 2, it was removed from the printing drum 2 by the stencil discharging unit 50.

Then, it was observed with naked eyes and under an optical microscope that all the deposits, which had been formed on the thermal printing head 32 in the vicinity of the heating elements (i.e., the area within 100 μm outwardly from the downstream end of heating elements in the stencil-sheet conveying direction) and outwards therefrom, were removed.

Meanwhile, according to experiments made by the present inventors, as long as there is no deposit in the area within 100 μm outwardly from the downstream end of heating elements in the direction in which stencil is conveyed, printed images are not affected even if there are deposits extending outwardly from the above area.

Example 2

Cleaning by Use of a Stencil Sheet as a Deposit-cleaning Sheet in Solid Printing Mode By use of the rotary stencil printing apparatus of FIG. 1, the step for making masters for stencil printing from the roll of stencil sheet S was repeated two-hundred (200) times based on an original having 20% printed area, after the thermal printing head had previously been cleaned. Then, deposits were formed on the thermal printing head on the downstream side in the stencil-sheet conveying direction, which originated from a point within 100 μm outwardly from the downstream end of heating elements and further extended outwardly therefrom.

Next, while a stencil sheet S of a size corresponding to one master for printing was conveyed to pass the thermal printing head by 10 cm in the printing apparatus of FIG. 1, the thermal printing head was kept in solid printing mode in which all the heating elements were heated.

After the deposit-cleaning sheet that had passed the thermal printing head was clamped at an end thereof and wound around the printing drum 2, it was removed from the printing drum 2 by the stencil discharging unit 50.

Then, it was observed with naked eyes and under an optical microscope that the deposits were moved downwards from the above originating point, and removed from the area in the vicinity of the heating elements (i.e., the area within 100 μm outwardly from the downstream end of heating elements).

Example 3

Cleaning by Use of a Stencil Sheet as a Deposit-cleaning Sheet in Solid Printing Mode Every Time When Master is Made Upon ordinary master-making operation of the stencil printing apparatus of FIG. 1, a master for printing one original is made by forming perforations corresponding to images to be printed in the central region of length L3 of the stencil sheet S, as shown in FIG. 3. Thus, the master is not perforated in the end regions of length L2 and L4, and the region of length L2 is clamped by the clamp plate 5 of the printing drum 2.

When the end region of length L2 of the stencil sheet S passes the thermal printing head in the printing apparatus of FIG. 1, all the heating elements of the head were heated to make perforations for solid printing in the region of length L1 (5 cm) shown in FIG. 3. Then, perforations were made in the central region of length L3 based on an original having 20% printed area. Then, the stencil sheet S that had been perforated was clamped at an end thereof and wound around the printing drum 2, and was then removed from the printing drum 2 by the stencil discharging unit 50.

The above series of perforating operation was repeated two-hundred (200) times. Then, it was observed with naked eyes and under an optical microscope that the originating point of deposits was moved downwards from that of Example 2 found before cleaning in the solid printing mode, and there was no deposit in the area within 100 μm outwardly from the downstream end of heating elements in the direction in which stencil sheet is conveyed.

Example 4

Cleaning by Use of a Stencil Sheet as a Deposit-cleaning Sheet after Pre-heating the Thermal Printing Head By use of the rotary stencil printing apparatus of FIG. 1, the step for making masters for stencil printing from the roll of stencil sheet S was repeated two-hundred (200) times based on an original having 20% printed area, after the thermal printing head had previously been cleaned. Then, deposits were formed on the thermal printing head on a side downstream in the stencil-sheet conveying direction, which originated from a point within 100 μm outwardly from the downstream end of heating elements and further extended outwardly therefrom.

Next, before the stencil sheet S was subjected to perforation to make a master, the heating elements of the thermal printing head were heated in the stencil printing apparatus of FIG. 1 until the temperature became 70° C. in the region where deposits occurred. Immediately after that, the heating elements were turned off, and the end region of length L2 shown in FIG. 3 of the stencil sheet S was allowed to pass the thermal printing head. In this instance, no perforation was made in the end region. Then, the region of length L3 shown in FIG. 3 was allowed to pass the thermal printing head so that perforations were made therein based on an original having 20% printed area, and then the region of length L4 was allowed to pass the thermal printing head without making any perforation therein. The stencil sheet S that had been perforated was clamped at an end thereof and wound around the printing drum 2, and was then removed from the printing drum 2 by the stencil discharging unit 50.

The above series of steps from the pre-heating of deposits to 70° C. through the discharge of the stencil sheet to the discharging unit 50 was repeated two-hundred (200) times. Then, it was observed with naked eyes and under an optical microscope that there was no deposit in the vicinity of the heating elements (i.e., the area within 100 μm outwardly from the downstream end of heating elements in the direction in which stencil sheet is conveyed) or any area outwardly farther than that area.

Example 5

Cleaning by Use of a Stencil Sheet as a Deposit-cleaning Sheet after Pre-heating the Thermal Printing Head By use of the rotary stencil printing apparatus of FIG. 1, the step for making masters for stencil printing from the roll of stencil sheet S was repeated two-hundred (200) times based on an original having 20% printed area, after the thermal printing head had previously been cleaned. Then, deposits were formed on the thermal printing head on a side downstream in the stencil-sheet conveying direction, which originated from a point within 100 μm outwardly from the downstream end of heating elements and further extended outwardly therefrom.

Next, before the stencil sheet S was subjected to perforation to make a master, the heating elements of the thermal printing head were heated in the stencil printing apparatus of FIG. 1 until the temperature became 70° C. in the above region where deposits occurred. Immediately after that, the heating elements were turned off, and the stencil sheet S corresponding to one master for printing as a deposit-cleaning sheet was allowed to pass the thermal printing head. In this instance, no perforation was made in the stencil sheet. Then, the deposit-cleaning sheet that had passed the thermal printing head was clamped at an end thereof and wound around the printing drum 2, and was then removed from the printing drum 2 by the stencil discharging unit 50.

Then, it was observed with naked eyes and under an optical microscope that all the deposits, which had been formed on the thermal printing head 32 in the vicinity of the heating elements (i.e., the area within 100 μm outwardly from the downstream end of heating elements in the stencil-sheet conveying direction) and outwards therefrom, were removed.

Example 6

Cleaning by Use of Wood Free Paper as a Deposit-cleaning Sheet after Pre-heating the Thermal Printing Head The stencil printing apparatus was operated in the same manner as in Example 5, except that the heating elements of the thermal printing head were heated until the temperature became 25, 40, 50, 60, 70 or 80° C. in the region where deposits occurred prior to cleaning, and that a piece of wood free paper which had a size corresponding to a master for A4 size printing was used as a deposit-cleaning sheet in place of the stencil sheet.

Then, the thermal printing head 32 was observed with naked eyes and under an optical microscope to examine whether deposits remained in the area within 100 μm outwardly from the downstream end of heating elements in the direction in which the stencil sheet was conveyed. The observation was evaluated as follows:

(+): Deposits remained.

(−): No deposit remained.

The results are shown in Table 1.

TABLE 1

Results of Example 7

| Pre-heating temperature | 25° C. | 40° C. | 50° C. | 60° C. | 70° C. | 80° C. |
|---|---|---|---|---|---|---|
| Evaluation | (+) | (+) | (−) | (−) | (−) | (−) |

From Table 1, it is understood that cleaning of the thermal printing head is possible when the area where deposits occur is heated to 50° C. or higher.

According to the present method for cleaning a thermal printing head, deposits fixed to the vicinity of each heating element can be molten and moved or removed away from the vicinity of heating elements without damaging the thermal printing head. In case of stencil printing machines, the thermal printing head used for making masters for printing can readily be cleaned without any specially processed stencil sheet.

What is claimed is:

1. A method for controlling a unit for perforating a stencil sheet to make a master for stencil printing, said unit comprising a thermal printing head having a plurality of heating elements arranged transversely to a direction in which said stencil sheet is conveyed, and a platen roller disposed to convey said stencil sheet while said stencil sheet is kept in contact with said thermal printing head, which comprises a first step of conveying said stencil sheet in the above direction by a predetermined distance while said heating elements are turned on to heat the vicinity of said elements, in order to prevent deposits from adhering to said thermal printing head, and a second step of further conveying said stencil sheet in the above direction in order to make perforations in the region upstream of the stencil sheet in accordance with an image to be printed.

2. A controlling method according to claim 1, in which said heating elements are all turned on in the first step so as to make perforations for solid printing in said stencil sheet.

3. A method for controlling a unit for perforating a stencil sheet to make a master for stencil printing, said unit comprising a thermal printing head having a plurality of heating elements arranged transversely to a direction in which said stencil sheet is conveyed, and a platen roller disposed to convey said stencil sheet while said stencil sheet is kept in contact with said thermal printing head, which comprises a first step of turning on said heating elements until the vicinity of said elements is heated, and then immediately turning off the elements and conveying said stencil sheet in the above direction by a predetermined distance, in order to prevent deposits from adhering to said thermal printing head, and a second step of further conveying said stencil sheet in the above direction in order to make perforations in the region upstream of the stencil sheet in accordance with an image to be printed.

4. A method for controlling a unit for perforating a stencil sheet to make a master for stencil printing, said unit comprising a thermal printing head having a plurality of heating elements arranged transversely to a direction in which said stencil sheet is conveyed, and a platen roller disposed to convey said stencil sheet while said stencil sheet is kept in contact with said thermal printing head, which comprises a first step of turning on said heating elements until the vicinity of said elements is heated, and conveying said stencil sheet in the above direction by a predetermined distance while said elements are kept turned on, in order to prevent deposits from adhering to said thermal printing head, and a second step of further conveying said stencil sheet in the above direction in order to make perforations in the region upstream of the stencil sheet in accordance with an image to be printed.

5. A controlling method according to claim 1, 3 or 4, in which the vicinity of said heating elements is heated to 50° C. or higher by the elements in the first step.

6. A controlling method according to any one of claims 1 to 4, in which the first step is conducted every time when the second step is conducted.

7. A controlling method according to any one of claims 1 to 4, in which the first step is conducted once after the second step has been conducted several times.

8. A controlling method according to claim 5, in which the first step is conducted every time when the second step is conducted.

9. A controlling method according to claim 5, in which the first step is conducted once after the second step has been conducted several times.

* * * * *